US012480295B2

(12) United States Patent
Williams

(10) Patent No.: US 12,480,295 B2
(45) Date of Patent: Nov. 25, 2025

(54) SINK TOP MAT

(71) Applicant: Thelma-Teresa C. Williams, Saint Charles, MO (US)

(72) Inventor: Thelma-Teresa C. Williams, Saint Charles, MO (US)

( * ) Notice: Subject to any disclaimer, the term of this patent is extended or adjusted under 35 U.S.C. 154(b) by 112 days.

(21) Appl. No.: 18/516,713

(22) Filed: Nov. 21, 2023

(65) Prior Publication Data

US 2024/0167257 A1 May 23, 2024

Related U.S. Application Data

(60) Provisional application No. 63/384,900, filed on Nov. 23, 2022.

(51) Int. Cl.
*E03C 1/186* (2019.01)

(52) U.S. Cl.
CPC ..... *E03C 1/186* (2013.01)

(58) Field of Classification Search
CPC ..... E03C 1/186; E03C 1/18
USPC ..... 4/631, 637, 656
See application file for complete search history.

(56) References Cited

U.S. PATENT DOCUMENTS

| | | | | |
|---|---|---|---|---|
| 477,137 | A * | 6/1892 | Mesick | |
| 9,708,064 | B2 * | 7/2017 | Vandewall | B64D 11/02 |
| 2008/0263762 | A1 * | 10/2008 | Burns | E03C 1/186 4/657 |
| 2023/0226403 | A1 * | 7/2023 | Villency | A63B 71/0622 482/4 |

OTHER PUBLICATIONS

The Matte—Black, retrieved from the internet, retreved on Nov. 21, 2023; <URL: https://www.thematte.com/products/the-matte>.

LEMIKKLE Roll Up Dish Drying Rack 17.5" ×15.2" Over The Sink Dish Drying Rack, Multi-Purpose Kitchen Rolling Dish Drainer Foldable SUS 304 Stainless Steel Dish Drying Rack, retrieved from the internet, retrieved on Nov. 21, 2023; <URL: https://www.amazon.com/Fixparts-Multi-Purpose-Rollable-Stainless-Drainer/dp/B08RYCZC33?th=1>.

* cited by examiner

*Primary Examiner* — David J Walczak

(57) ABSTRACT

A sink top mat, capable of extending over a sink basin, having a plurality of slats, an at least one living hinge, and an at least one slot. The plurality of slots are connected via the living hinge, wherein the living hinge is located between the two adjacent slats. The at least one slot is a channel through a portion of the living hinge, allowing for fluids to pass through the sink top mat. Additionally, the sink top mat may be rolled into a configuration for easy storage when not in use. To maintain the sink top mat in the rolled configuration, the mat may further comprise a closing mechanism.

20 Claims, 7 Drawing Sheets

SINK TOP MAT

FIELD OF THE INVENTION

The present invention relates generally to an accessory for a sink. More specifically, the present invention is a sink top map that extends across a user's sink to provide additional counter space.

BACKGROUND OF THE INVENTION

Bathroom and kitchen sinks come in many different sizes. More importantly, the counter areas surrounding these sinks are crucial workspace for the user. For example, in a bathroom environment, the sink may be a pedestal sink for decorative purposes (which has no counter space at all around the same), or the sink could be part of a small vanity where the counter space around the sink is very limited. In these instances, the individual using the sink to get ready (e.g., put makeup on, do their hair, shave, etc.) often places their products on the counter surrounding the sink. It thus becomes apparent that when the counter surface area is small (or non-existent in the case of a pedestal sink) the user very quickly finds themselves without sufficient space for their stuff, to the point where the sink itself is used to hold a brush, hairdryer or other multiple items.

In a kitchen environment, the sink may not have large amounts of counter space around the same (e.g., small apartments, studios or small homes with smaller kitchens). As such, with smaller counter areas around the sink, the use of the same can sometimes be more difficult. For example, the user is cleaning dishes and utensils, and doesn't have sufficient counter space to hold the dishes or utensils before drying.

It is therefore an aspect of the present invention to provide an easy to use, easy to store device that allows a user to increase the surface area of the space around the sink and turn the sink itself into usable counter like surface area.

DETAIL DESCRIPTIONS OF THE INVENTION

Figure 1:
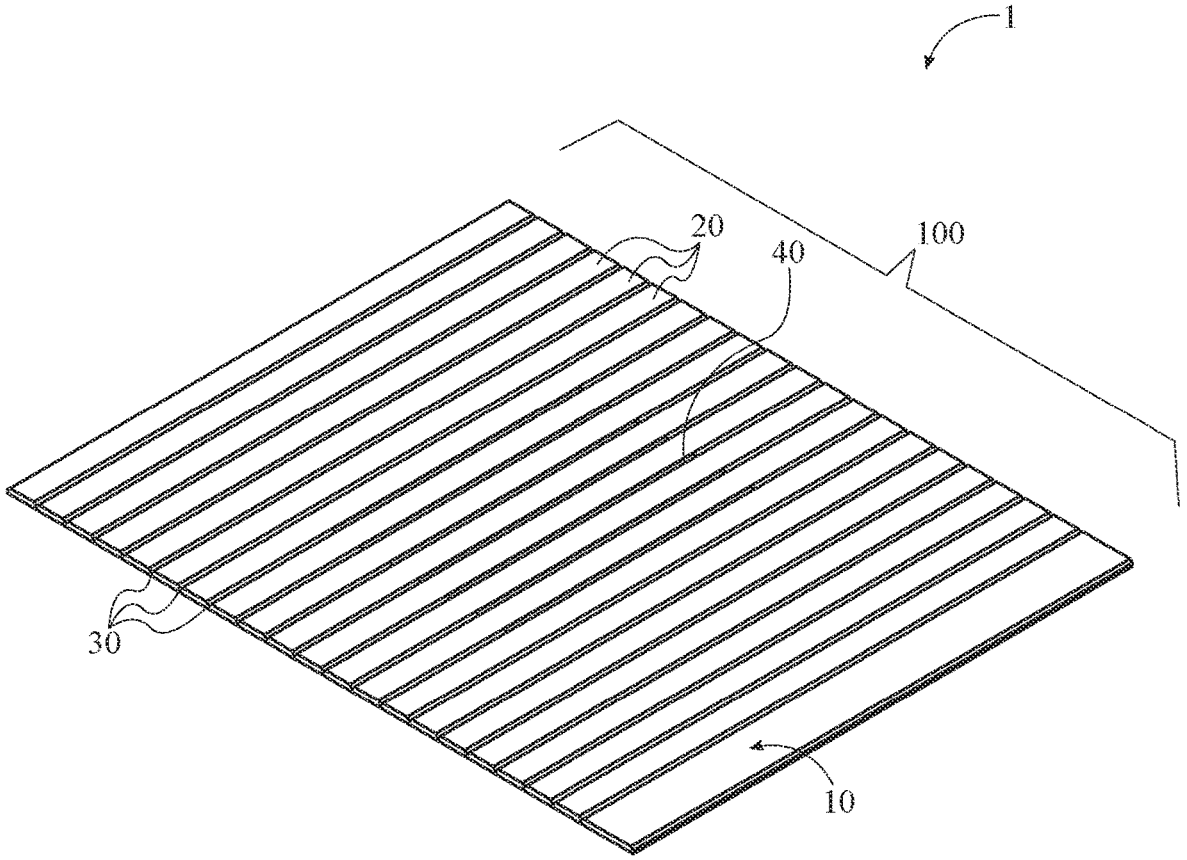
FIG. 1 is a top perspective view of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a sink top mat 1, embodiments of the present disclosure are not limited to use only in this context.

The present invention, as shown in FIGS. 1-7, and described herein, is a sink top mat 1. In the preferred embodiment of the present invention, the sink top mat 1 may be extended across a countertop, covering a sink basin, thus providing additional counter space for a user. As shown in FIG. 1, the sink top mat 1 of the present invention comprises a plurality of slats 20, an at least one living hinge 30, and an at least one slot 40. In the preferred embodiment of the present invention, the sink top mat 1 comprises a plurality of living hinges 30 and a plurality of slots 40. As shown in FIG. 1, each slat 20 of the plurality of slats 20 are positioned coplanar to the adjacent slat.

Figure 2:
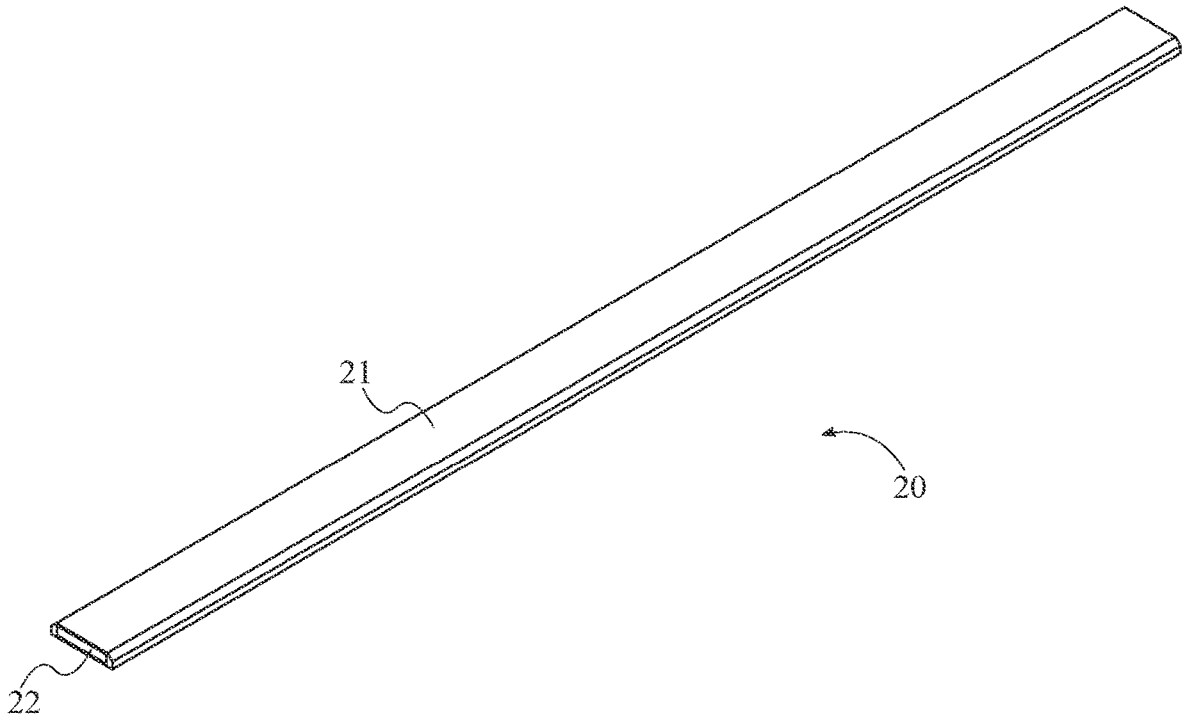
FIG. 2 is a perspective view of a single slat of the present invention.

As shown in FIG. 2, each slat 20 of the plurality of slats 20 comprises a sheath 21 and a rod, wherein the rod 22 is an elongated member housed within the sheath 21. In the preferred embodiment of the present invention, the sheath 21 is composed of a food grade methyl vinyl silicone rubber. In alternate embodiments of the present invention, additional materials may be used including high temperature vulcanizing (HTV) silicone rubber, polyester, silicone-based textiles, carbon fiber, Kevlar, and polyvinyl chloride (PVC). Likewise, within the preferred embodiment of the present invention, each of the rods 22 is composed of rigid nylon. Furthermore, in the preferred embodiment, the rigid nylon is manufactured via molding process.

Figure 3:
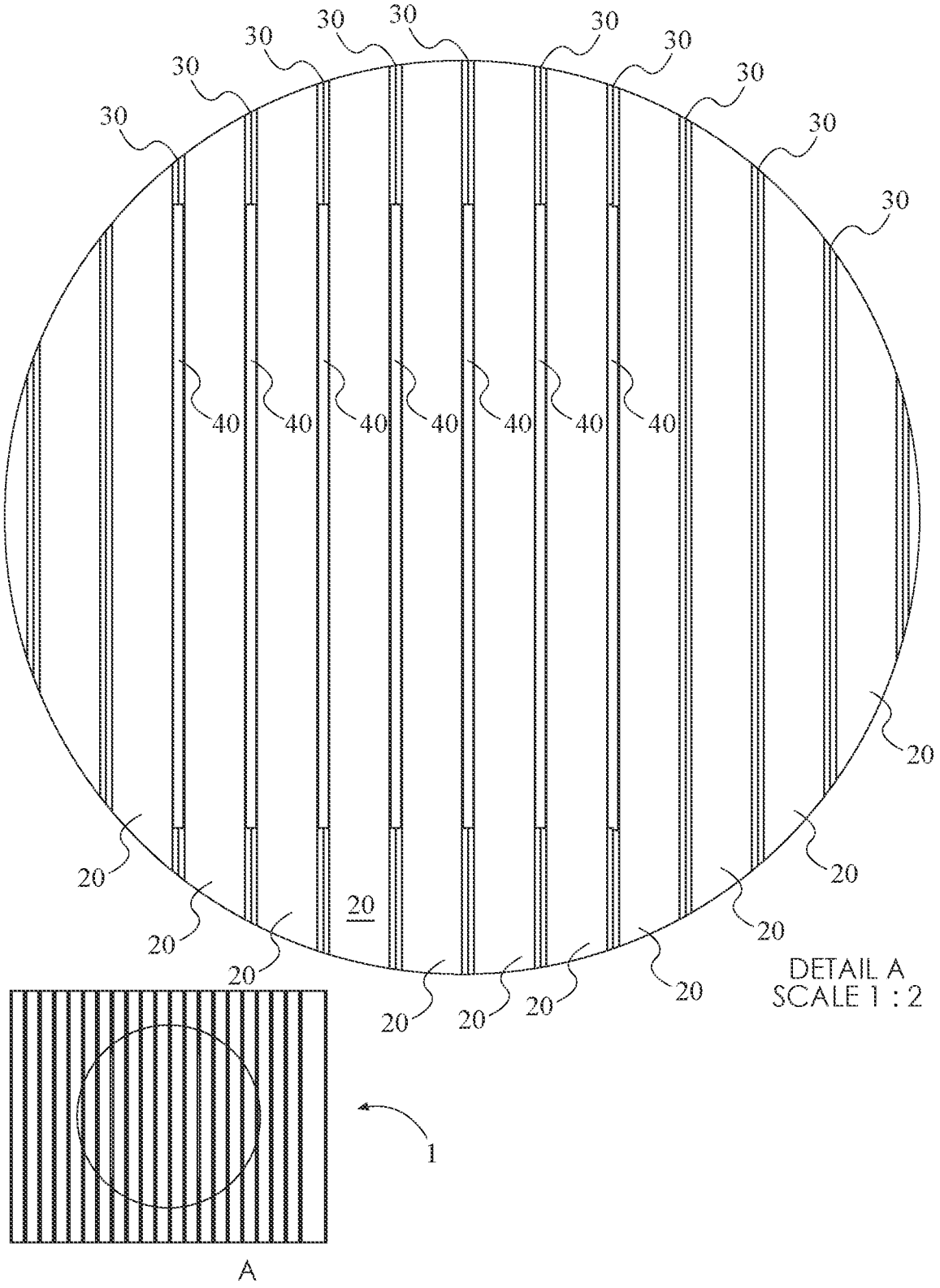
FIG. 3 is a detailed view of the present invention.

Referring to FIG. 3, each slat 20 of the plurality is coplanar to the adjacent slat 20 wherein the living hinges 30 connect each adjacent slat 20 providing a flexible joint between each adjacent slat. The living hinges 30 within the context of the present invention are composed of the same material as the sheath 21 material. Furthermore, the at least one slot 40 is a through channel between two adjacent slats 20 of the plurality of slats 20, wherein a portion of the living hinge 30 is extruded, resulting in a slot 40. In the preferred embodiment of the present invention, the slot 40 is intended to allow water, steam, and other fluids to pass through the sink top mat 1. Although the at least one slot 40 is shown to reside between at least two centrally located slats 20, in alternate embodiments, the at least one slot 40, may reside between at least any two adjacent slats 20 composing the sink top mat 1.

Figure 4:
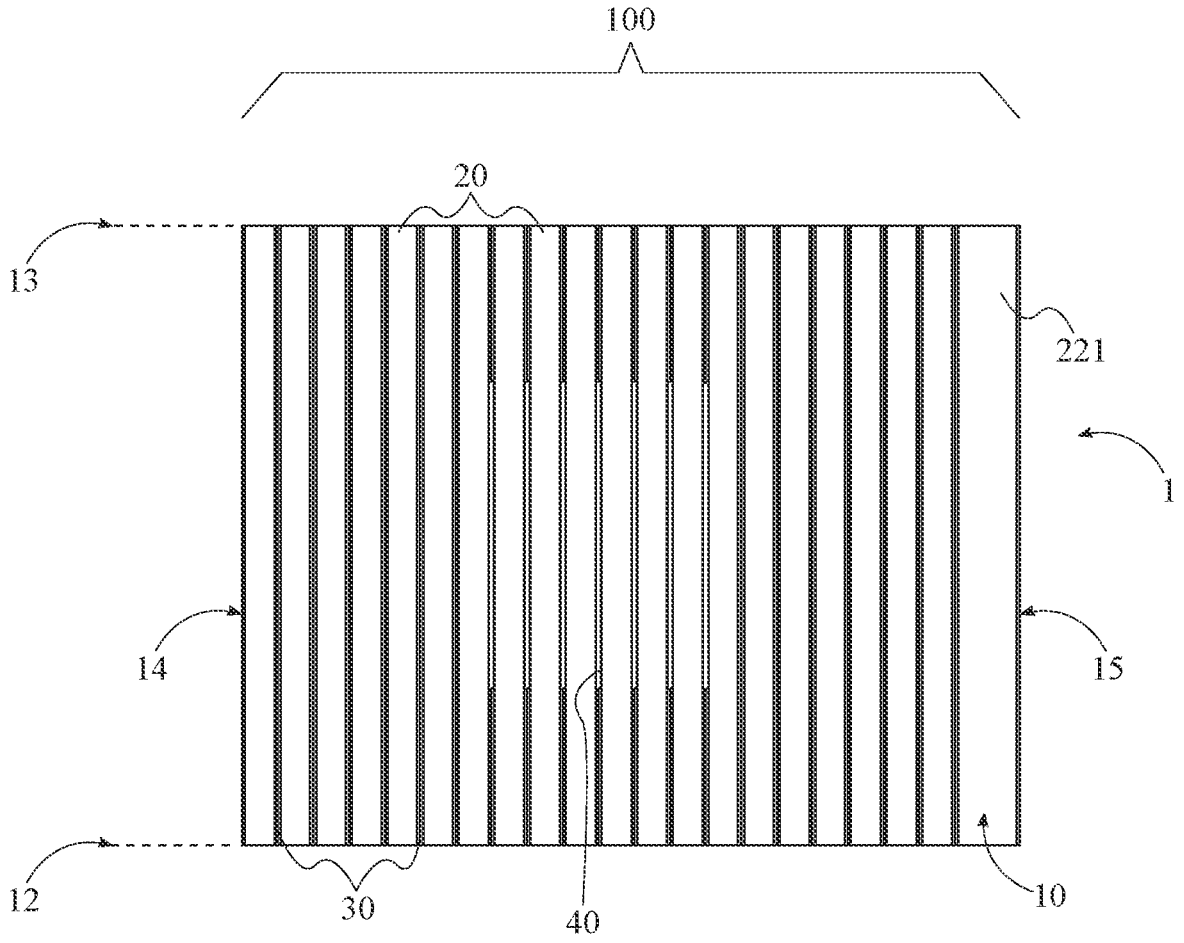
FIG. 4 is a top view of the present invention.
Figure 5:
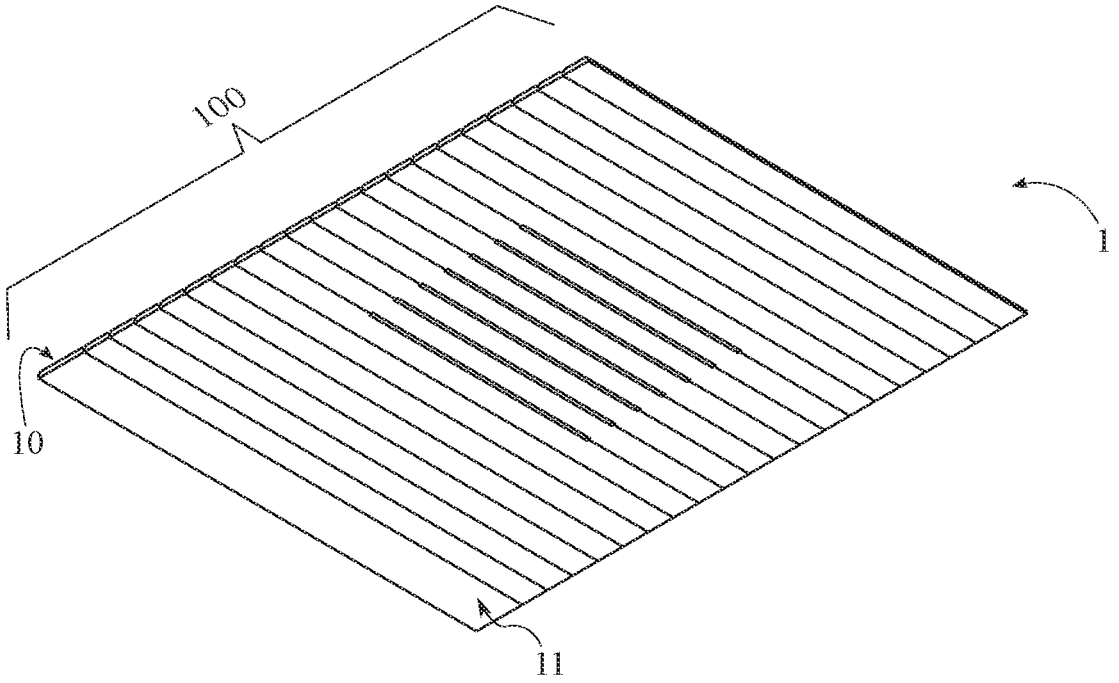
FIG. 5 is a bottom perspective view of the present invention.

As shown in FIG. 4 and FIG. 5, the sink top mat 1 of the present invention comprises a rectangular shape having a top surface 10, a bottom surface 11, a front side 12, a rear side 13, a first lateral side 14, and a second lateral side 15. In the preferred embodiment of the present invention, the top surface 10 is the upwardly facing surface, wherein the bottom surface 11 is the opposite parallel surface to said top surface 10. Furthermore, in the preferred embodiment of the present invention, the front side 12 is opposite and parallel to the rear side 13; the first lateral side 14 is opposite and parallel to the second lateral side 15; and the front side 12 and the rear side 13 are perpendicular to the first lateral side 14 and the second lateral side 15.

Figure 6:
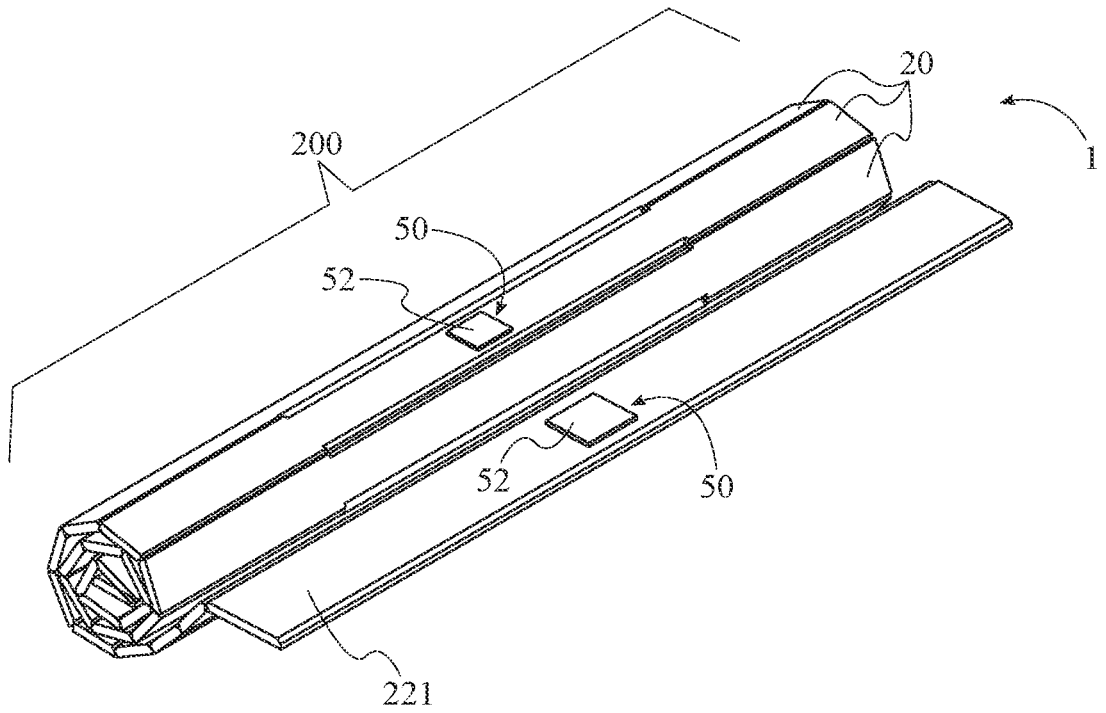
FIG. 6 is a perspective view of the present invention in the rolled configuration wherein the mat comprises a magnetic closing mechanism.
Figure 7:
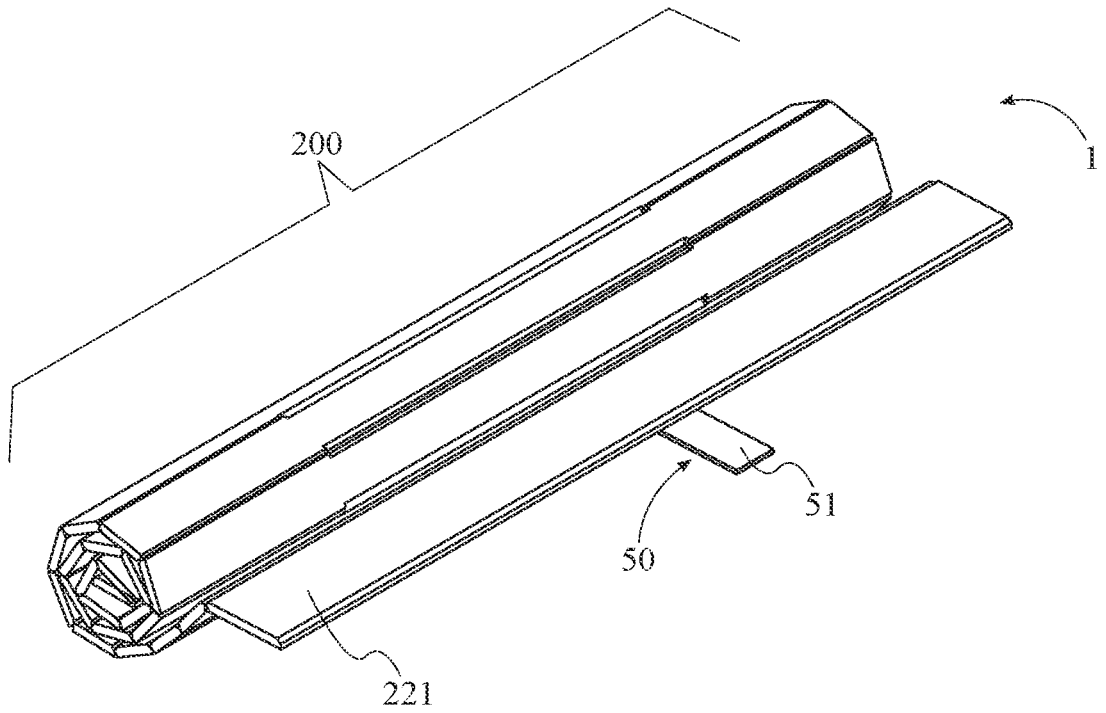
FIG. 7 is an alternate perspective view of the present invention in the rolled configuration wherein the mat comprises a strap closing mechanism.

The present invention further comprises an open configuration 100, as shown in FIG. 5, and a rolled configuration 200, as shown in FIG. 6 and FIG. 7. In the open configuration 100, also referred to herein as the use configuration, the sink top mat 1 comprises a flat planar structure, wherein the top surface 10 and the bottom surface 11 are parallel. Contrarily, as the rolled configuration 200 is a configuration wherein the sink top mat 1 is rolled from the first lateral side 14 to the second lateral side 15, into a coiled body.

In some embodiments of the present invention, the sink top mat 1 may further comprise a closing mechanism 50. In the preferred embodiment, the closing mechanism 50 secures the sink top mat 1 in the rolled configuration 200 while not in use. In some embodiments of the present invention, the closing mechanism 50 is an at least one magnet 52. In some embodiments wherein the present invention comprises an at least one magnet 52, the present invention comprises two corresponding magnets 52, wherein a first magnet 52 may magnetically secure to the second magnet 52. In alternate embodiments, the closing mechanism 50 is a strap 51. Further, in some embodiments of the present invention, the sink top mat 1 may further comprise an end slat, wherein the end slat 20 may comprise the closing mechanism 50.

While in the use configuration, and extending across the sink basin, a user may place items on the top surface 10 of the sink top mat 1. Further, given the material of the sheath 21, items that produce high temperatures such as blow dryers, pots, pans, curling irons, and items of the like, may also be safely rested on the top surface 10 of the sink top mat 1. Lastly, although the present invention, in its preferred configuration is a rectangular device, the present invention shall not be limited to such and may comprise alternative shapes.

Although the invention has been explained in relation to its preferred embodiment, it is to be understood that many other possible modifications and variations can be made without departing from the spirit and scope of the invention.

What is claimed is:

1. A sink top mat comprising:

a plurality of slats, a plurality of living hinges, and at least one slot;

wherein:

the plurality of slats are elongated members wherein each slat of the plurality of slats is positioned parallelly adjacent to each of the other slats of the plurality;

the plurality of living hinges connecting the plurality of slats wherein two adjacent slats share one living hinge of the plurality of living hinges;

each living hinge of the plurality of living hinges is interposed between each of the adjacent slats of the plurality of slats; and the at least one slot located between two slats of the plurality of slats whereby the at least one slot is a channel through at least one living hinge of the plurality of living hinges.

2. The sink top mat as claimed in claim 1, wherein each slat of the plurality of slats is composed of a sheath and a rod, wherein the rod is an elongated member housed within the sheath.

3. The sink top mat as claimed in claim 2, wherein the sheath is composed of a food grade methyl vinyl silicone rubber material.

4. The sink top mat as claimed in claim 2, wherein the rod is composed of a nylon material.

5. The sink top mat as claimed in claim 1 further comprising an open configuration whereby the sink top mat is configured in a flat extended configuration.

6. The sink top mat as claimed in claim 5 wherein the sink top mat, when in the open configuration, comprises a rectangular shape comprising a top surface and a bottom surface, wherein the top surface and the bottom surface are opposite parallel surfaces of the sink top mat.

7. The sink top mat as claimed in claim 1 further comprising a rolled configuration wherein the sink top mat is rolled into a coiled body.

8. The sink top mat as claimed in claim 7, further comprising a closing mechanism to secure the sink top mat in the rolled configuration.

9. The sink top mat as claimed in claim 8 wherein the closing mechanism is a strap.

10. The sink top mat as claimed in claim 8 wherein the closing mechanism is an at least one magnet.

11. A sink top mat comprising:

a plurality of slats, a plurality of living hinges, and at least one slot;

wherein:

the plurality of slats are elongated members wherein each slat of the plurality of slats is positioned parallelly adjacent to each of the other slats of the plurality;

each slat of the plurality of slats composed of a sheath and a rod, wherein the rod is an elongated member housed within the sheath;

the plurality of living hinges connecting the plurality of slats wherein two adjacent slats share one living hinge of the plurality of living hinges between each adjacent slats; and the at least one slot located between two slats of the plurality whereby the at least one slot is a channel through at least one living hinge of the plurality of living hinges.

12. The sink top mat as claimed in claim 11, wherein the sheath is composed of a food grade methyl vinyl silicone rubber material.

13. The sink top mat as claimed in claim 11, wherein the rod is composed of a nylon material.

14. The sink top mat as claimed in claim 11 wherein the sink top mat comprises a rectangular shape comprising a top surface and a bottom surface, wherein the top surface and the bottom surface are opposite parallel surfaces of the sink top mat.

15. The sink top mat as claimed in claim 14 further comprising an open configuration and a rolled configuration;

the open configuration whereby the sink top mat is configured in a flat extended configuration; and the rolled configuration wherein the sink top mat is rolled into a coiled body.

16. The sink top mat as claimed in claim 15, further comprising a closing mechanism to secure the sink top mat in the rolled configuration wherein said closing mechanism is a strap.

17. The sink top mat as claimed in claim 15, further comprising a closing mechanism to secure the sink top mat in the rolled configuration wherein said closing mechanism is an at least one magnet.

18. A sink top mat comprising:

a plurality of slats, a plurality of living hinges, and at least one slot;

wherein:

the plurality of slats are elongated members wherein each slat of the plurality of slats is positioned parallelly adjacent to each of the other slats of the plurality;

each slat of the plurality of slats composed of a sheath and a rod, wherein the rod is an elongated member housed within the sheath;

each sheath being composed of a food grade methyl vinyl silicone rubber material;

each rod being composed of a nylon material;

the plurality of living hinges connecting the plurality of slats wherein two adjacent slats share one living hinge of the plurality of living hinges such that each shared living hinge is interposed between said adjacent slats; and the at least one slot located between two slats of the plurality whereby the at least one slot is a channel through at least one living hinge of the plurality of living hinges.

19. The sink top mat as claimed in claim 18 wherein the sink top mat comprises a rectangular shape comprising a top surface and a bottom surface, wherein the top surface and the bottom surface are opposite parallel surfaces of the sink top mat;

the sink top mat further comprising an open configuration and a rolled configuration;

the open configuration whereby the sink top mat is configured in a flat extended configuration; and the rolled configuration wherein the sink top mat is rolled into a coiled body.

20. The sink top mat as claimed in claim 19, further comprising a closing mechanism to secure the sink top mat in the closed configuration wherein said closing mechanism is selected from an at least one magnet and a strap.

* * * * *